US009580294B2

(12) United States Patent
Lewis et al.

(10) Patent No.: US 9,580,294 B2
(45) Date of Patent: Feb. 28, 2017

(54) COMPUTER PROGRAM AND METHOD FOR VERIFYING CONTAINER OF MATERIAL TO BE DISPENSED

(71) Applicant: Brewer Science Inc., Rolla, MO (US)

(72) Inventors: Adam Lewis, Owensville, MO (US); Kevin Edwards, Rolla, MO (US)

(73) Assignee: Brewer Science Inc., Rolla, MO (US)

( * ) Notice: Subject to any disclaimer, the term of this patent is extended or adjusted under 35 U.S.C. 154(b) by 97 days.

(21) Appl. No.: 14/559,423

(22) Filed: Dec. 3, 2014

(65) Prior Publication Data

US 2016/0159509 A1 Jun. 9, 2016

(51) Int. Cl.

| | |
|---|---|
| ***B67D 7/34*** | (2010.01) |
| ***B65B 57/00*** | (2006.01) |
| ***B67D 7/02*** | (2010.01) |
| *B67D 7/32* | (2010.01) |

(52) U.S. Cl.

CPC ..... *B67D 7/348* (2013.01); *B65B 57/00* (2013.01); *B67D 7/02* (2013.01); *B67D 7/344* (2013.01); *B67D 7/346* (2013.01); *B67D 7/3209* (2013.01)

(58) Field of Classification Search

CPC ..... B67D 7/0283; B67D 7/346; B67D 7/348; G05D 7/0617; G05B 15/02; B65B 57/00; H01L 21/67294

USPC ..... 700/237, 245; 222/382, 52

See application file for complete search history.

(56) References Cited

U.S. PATENT DOCUMENTS

| | | | | |
|---|---|---|---|---|
| 5,875,921 | A | 3/1999 | Osgar et al. | |
| 6,015,068 | A | 1/2000 | Osgar et al. | |
| 6,443,334 | B1 * | 9/2002 | John | B67D 1/0004 222/146.6 |
| 6,879,876 | B2 | 4/2005 | O'Dougherty et al. | |
| 7,083,093 | B1 * | 8/2006 | Brown | B67D 7/348 235/383 |
| 7,477,959 | B2 | 1/2009 | Yang et al. | |
| 7,664,568 | B2 | 2/2010 | O'Dougherty et al. | |
| 7,702,418 | B2 * | 4/2010 | O'Dougherty | B67D 7/0283 700/231 |
| 7,747,344 | B2 | 6/2010 | O'Dougherty et al. | |

(Continued)

OTHER PUBLICATIONS

International Search Report and Written Opinion mailed Aug. 26, 2015 in corresponding PCT/US2014/068383 filed Dec. 3, 2014.

(Continued)

*Primary Examiner* — Timothy Waggoner
(74) *Attorney, Agent, or Firm* — Hovey Williams LLP

(57) ABSTRACT

A system for verifying a container of a material before the material is transferred to a process. The system includes a conduit that extends through a mouth of the container. The conduit is supported by an arm that moves between a first position in which the conduit extends through the mouth, and a second position in which the conduit is removed and moved away from the mouth. A reading device extracts information about the container from an information storage element. A computer program receives input regarding the extracted information, receives input regarding the process, and determining whether the container is correct for the process. The program prevents the arm from moving to the first position, and only if the container is determined to be correct does the program allow the arm to move to the first position so that the material can be transferred.

47 Claims, 10 Drawing Sheets

(56) References Cited

U.S. PATENT DOCUMENTS

| | | | | |
|---|---|---|---|---|
| 8,140,184 | B2 * | 3/2012 | Chen | G01F 11/284 141/94 |
| 8,150,549 | B2 | 4/2012 | O'Dougherty et al. | |
| 8,571,708 | B2 * | 10/2013 | Rob | A61J 1/20 318/568.11 |
| 2007/0179448 | A1 | 8/2007 | Lim et al. | |
| 2011/0318845 | A1 * | 12/2011 | Kurono | G01N 35/0092 436/174 |
| 2012/0186671 | A1 | 7/2012 | O'Dougherty et al. | |
| 2013/0026180 | A1 | 1/2013 | Takahashi et al. | |
| 2013/0218511 | A1 * | 8/2013 | Mager | G01G 23/3735 702/129 |

OTHER PUBLICATIONS

Crabtree et al., "Photoresist Bar Code Monitor," Fab Engineering and Operations, Feb. 2009, Issue 06, 5 pages.

PR/Protect Photoresist Validation System, Landry Engineering Development, LLC, 2009, www.LandryEngineering.com, 2 pages.

* cited by examiner

COMPUTER PROGRAM AND METHOD FOR VERIFYING CONTAINER OF MATERIAL TO BE DISPENSED

FIELD

The present invention relates to systems and methods for managing the dispensation of materials from containers.

BACKGROUND

Systems that manage the dispensation of materials from containers are often used in the biomedical, life sciences, electronics, photolithography, and semiconductor industries. For example, such systems are used in the semiconductor industry to manage the transfer of high-value liquids from bottles to coating systems. Typically, these systems include an apparatus having a connector that is positionable over a mouth of the container, and a conduit that extends through the mouth and into the container to access the material.

Such systems attempt to ensure that the correct materials are transferred from the correct containers. One solution is to label the containers with bar codes. An operator uses a bar code scanner to read information from a label on a container, and software uses that information to determine whether the container is the correct container. However, this solution does not prevent the operator from scanning the correct container and then using an incorrect container, or from using a container before or even without scanning it. Furthermore, systems employing this solution do not provide any trend, predictive, real-time, or messaging information, and do not physically facilitate removing and installing the containers. They also do not facilitate ongoing monitoring of product expiration dates or other changing conditions that may make the products in the containers unfit for use after initial acceptance.

Another solution is to use mechanical keys that distinguish between types of containers. More specifically, a particular mechanical key is installed on the connector or conduit, the correct container presents a particular corresponding structure operable to receive the key, and only if the particular mechanical key of the apparatus matches the particular corresponding structure of the container can the container be properly installed on the apparatus, the conduit fully extended into the container, and the material successfully transferred from therein. However, if an operator attempts to install an incorrect container, the error is not discovered until the conduit has at least partially entered the container and contaminated both the container and the conduit. Furthermore, the ability to discriminate between containers is limited to the number of available mechanical keys. As a result, all containers of a particular type are typically associated with the same mechanical key without regard to, e.g., lot number, expiration date, or other criteria. Additionally, systems that employ keys typically require use of a particular brand of containers that are provided with the structures that correspond to the keys.

This background discussion is intended to provide information related to the present invention which is not necessarily prior art.

SUMMARY

Embodiments of the present invention solve the above-described and other problems and limitations by providing a dispensing system and method that verifies containers of materials before the materials are transferred to processes.

The present invention combines the mechanical advantages of a key-based system with the informational and analytical advantages of a label-based system to greatly reduce mistakes and contamination.

A dispensing system constructed in accordance with the present invention may be operable to verify a container of a material before the material is transferred from the container to a process that uses the material, wherein the container has a mouth and presents an information storage element. In one embodiment, the dispensing system may comprise a connector operable to engage the container, and a conduit operable to extend through the mouth of the container and transfer the material from the container. A first arm may support the connector and the conduit and be operable to move between a first position in which the connector is engaged with the container and the conduit extends through the mouth of the container, and a second position in which the connector is disengaged from the container and the conduit is removed from the mouth of the container and moved away from the container such that the conduit is not positioned over the mouth of the container. A reading device may be operable to extract information about the container and the material in the container from the information storage element. A second arm may support the reading device and be operable to move between a first position in which the reading device is positioned adjacent to the information storage element, and a second position in which the reading device is not positioned adjacent to the information storage element. A computer program may be stored in an electronic memory, executable by an electronic device, and operable to prevent the first arm from moving to the first position, receive input from the reading device regarding the extracted information, to receive input regarding the process that uses the material, to determine whether the container and the material in the container is correct for the process that uses the material, and if the container is correct, then the computer program may allow the first arm to move to the first position so that the material can be transferred from the container.

In various implementations of this embodiment, the dispensing system may further include any one or more of the following additional features. The container may be a bottle, and the material may be a liquid. The information storage element may be a label, a tag, a radio-frequency identification device tag, an optical identification device, or a magnetic identification device. The conduit may be a tube. The first arm may be telescopic or otherwise moveable and may rotate and retract or otherwise move to achieve the first position and extend and rotate or otherwise move to achieve the second position. The reading device may be a quick response code reader, a linear bar code reader, a camera, a radio-frequency identification tag reader, an optical character recognition scanner, or a magnetic media reader. The second arm may be hinged and may rotate or otherwise move between the first position and the second position. The determination of whether the container and the material in the container are correct for the process may be based on a set of verification criteria used by the computer program, and information needed to determine whether the set of verification criteria is satisfied may be contained in the database. The set of verification criteria may be at least partly determinable by an operator of the dispensing system. The set of verification criteria may include a type of the material; a type of the container; an expiration date of the material; a time, day, or date at or on which the dispensing system is being used; lot numbers; process parameters, including which material is needed; a sequence or batch number; a manufacturer of the container or the material; or an identity of the operator. The electronic device may be a computer, a hand-held computing device, a microprocessor, an embedded computing device, a tablet, or a phone.

The apparatus may further include one or more sensors operable to measure a property of the apparatus, an environment of the container, the container, or the material, and to report the measured property to the computer program, and wherein the computer program may be operable to consider the reported measured property when determining whether to allow the first arm to move to the first position so that the material can be transferred from the container. The apparatus may further include a weight sensor located under the container and operable to measure a weight of the container and report the measured weight to the computer program, wherein the computer program may be operable to determine an amount of the material remaining in the container based on the measured weight of the container. The weight sensor may be a scale, a load cell, or a strain gauge. The apparatus may further include a communication element operable to communicate to an operator such information as successful/unsuccessful engagement of a new container, successful/unsuccessful verification of the new container, successful/unsuccessful release of an engaged container, and warning, trend, predictive, real-time, or information generated by the computer program. The communication element may be a visual communication element, an audible communication element, a display screen, one or more lights, a speaker, or a buzzer. The computer program may be operable to generate and send a message to another device, such as a mobile electronic device, concerning an aspect of the operation of the dispensing system, such as a problem with the apparatus, an attempt to install an incorrect container, a level of the material in the container, an upcoming need to replace the container, or a current environmental condition.

The dispensing system may include a plurality of the apparatuses operable to simultaneously transfer the same or different materials from multiple containers to one or more processes. Each of the apparatuses may be managed by a separate instance of the computer program, or all of the apparatuses may be managed by a single instance of the computer program.

Additionally, each of these implementations and embodiments may be alternatively characterized as methods based on their functionalities.

This summary is not intended to identify essential features of the present invention, and is not intended to be used to limit the scope of the claims. These and other aspects of the present invention are described below in greater detail.

DRAWINGS

Embodiments of the present invention are described in detail below with reference to the attached drawing figures, wherein.

Figure 1:
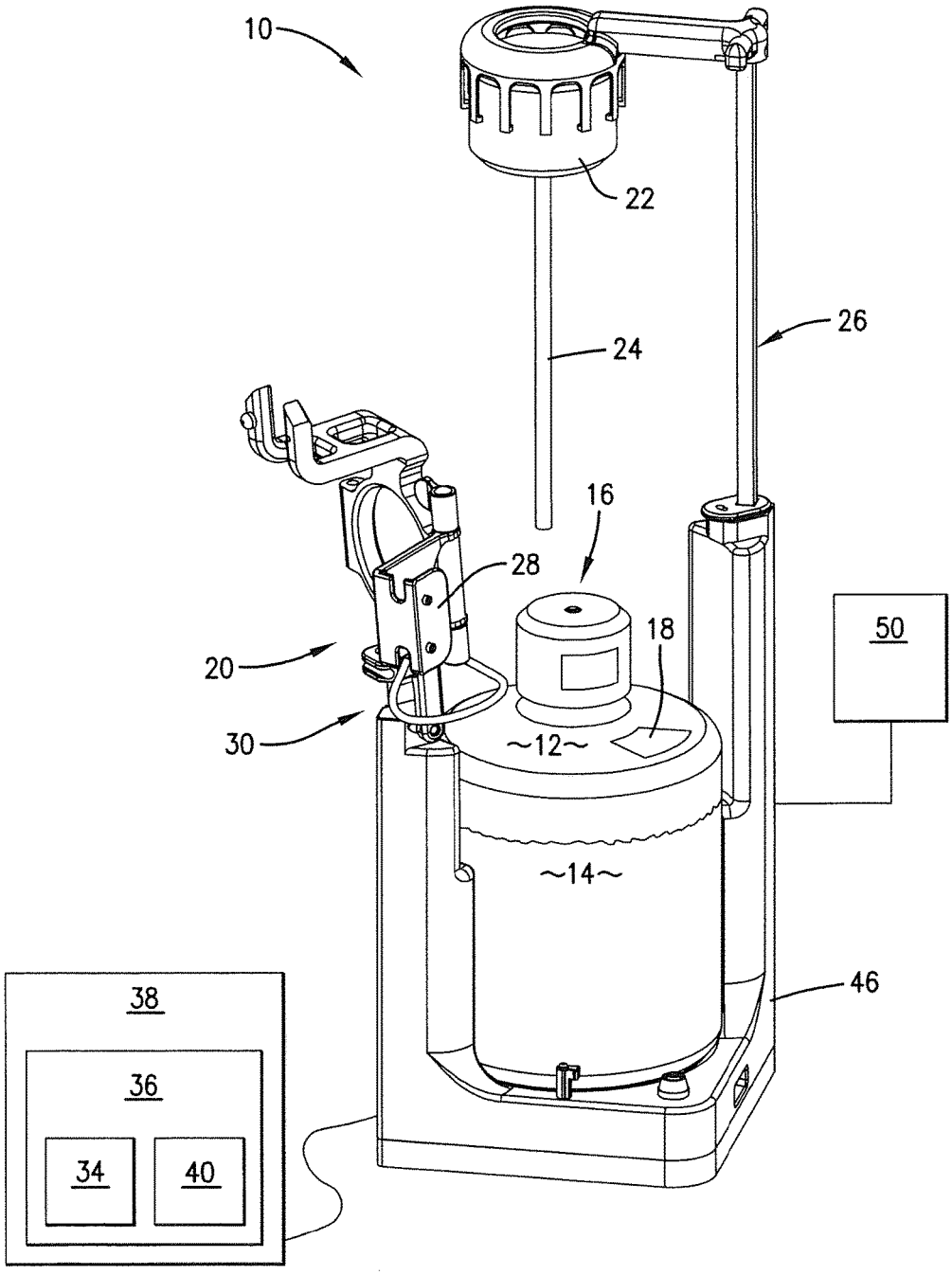
FIG. 1 is a depiction of a dispensing system constructed in accordance with an embodiment of the present invention.
Figure 2:
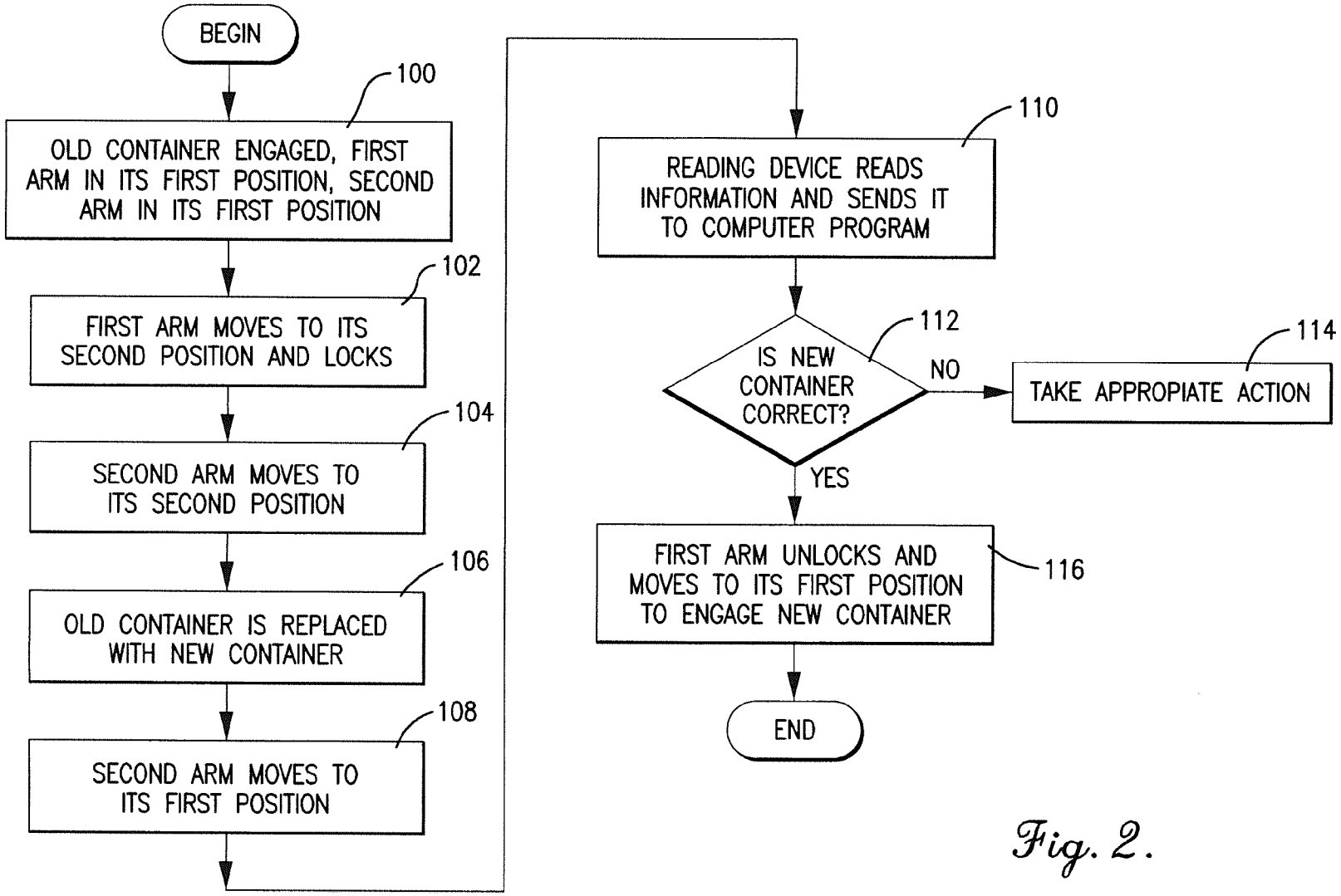
FIG. 2 is a flow diagram of steps involved in the operation of the dispensing system of FIG. 1.

The figures are not intended to limit the present invention to the specific embodiments they depict. The drawings are not necessarily to scale.

DETAILED DESCRIPTION

The following detailed description of embodiments of the invention references the accompanying figures. The embodiments are intended to describe aspects of the invention in sufficient detail to enable those with ordinary skill in the art to practice the invention. Other embodiments may be utilized and changes may be made without departing from the scope of the claims. The following description is, therefore, not limiting. The scope of the present invention is defined only by the appended claims, along with the full scope of equivalents to which such claims are entitled.

In this description, references to "one embodiment", "an embodiment", or "embodiments" mean that the feature or features referred to are included in at least one embodiment of the invention. Separate references to "one embodiment", "an embodiment", or "embodiments" in this description do not necessarily refer to the same embodiment and are not mutually exclusive unless so stated. Specifically, a feature, structure, act, etc. described in one embodiment may also be included in other embodiments, but is not necessarily included. Thus, particular implementations of the present invention can include a variety of combinations and/or integrations of the embodiments described herein.

Broadly characterized, the present invention provides a dispensing system and method that verifies containers (e.g., bottles) of materials (e.g., liquids, high-value liquids) before the materials are transferred from the containers to processes that use the materials. The present invention combines the mechanical advantages of a key-based system with the informational and analytical advantages of a label-based system to greatly reduce mistakes and contamination.

Referring to the figures, a dispensing system 10 is shown constructed in accordance with the present invention and operable to verify a container 12 of a material 14 before the material 14 is transferred from the container 12 to a process that uses the material 14, wherein the container 12 may have a mouth 16 and may present an information storage element 18. In various implementations, the container 12 may be, e.g., a bottle, jug, jar, box, or case constructed of, e.g., plastic, glass, or metal. The material 14 may be, e.g., a liquid, powder, or paste. The information storage element 18 may be, e.g., a label, tag, radio-frequency identification device (RFID) tag, optical identification tag, or magnetic identification tag affixed to, printed on, or otherwise associated with the container 12 and contain information in a readable or otherwise extractable form such as a quick response code (QR code®), linear bar code, text, or other captureable and interpretable symbols. The process that uses the material 14 may be, e.g., a biomedical, life sciences, electronics, photolithography, or semiconductor process.

Referring to FIG. 1, a first embodiment the dispensing system 10 may broadly comprise an apparatus 20 including a connector 22, a conduit 24, a first arm 26, a reading device 28, a second arm 30, and a computer program 34 stored in an electronic memory 36, executable by an electronic device 38, and operable to access a database 40. The connector 22 may be operable to fit over or around the mouth 16 of the container 12 and thereby engage the container 12. The conduit 24 may be located largely below the connector 22 and may be operable to extend through the mouth 16 of the container 12 so as to access and transfer the material 14 from the container 12. In various implementations, the conduit may be, e.g., a tube, a "dip tube", or a needle. In one implementation, the connector 22 and conduit 24 may be parts of a single assembly.

Figure 3:
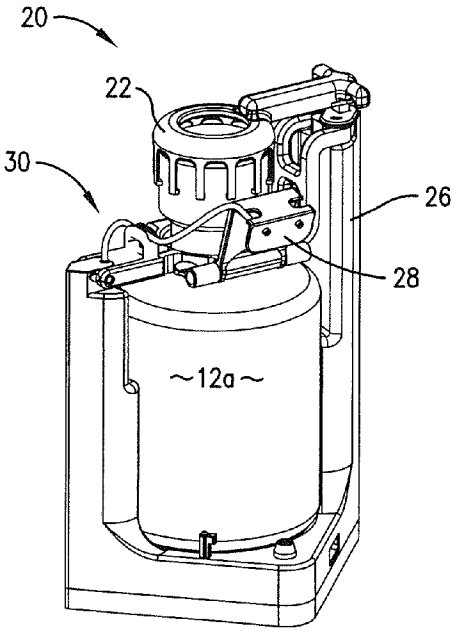
FIG. 3 is an isometric view of an apparatus component of the dispensing system of FIG. 1, wherein the apparatus is shown in a first stage of operation.

The first arm 26 may support the connector 22 and conduit 24 and may be operable to move between a first position (seen in FIG. 3) in which the connector 22 is engaged with the container 12 and the conduit 24 extends through the mouth 16 of the container 12, and a second position (seen in, e.g., FIG. 4) in which the connector 22 is disengaged from the container 12 and the conduit 24 is removed and rotated away such that the conduit 24 is not positioned over the mouth 16 of the container 12. In one implementation, the first arm 26 may be telescopic in nature and rotate and retract to achieve the first position and extend and rotate to achieve the second position.

The reading device 28 may be operable to extract information about the container 12 and the material 14 in the container 12 from the information storage element 18. In various implementations, the reading device 28 may be, e.g., a QR code® reader, a linear bar code reader, a camera, an RFID tag reader, a magnetic media reader, or an optical character recognition (OCR) scanner. The second arm 30 may support the reading device 28 and may be operable to move between a first position (seen in, e.g., FIG. 3) in which the reading device 28 is adjacently or otherwise positioned to read the information storage element 18, and a second position (seen in, e.g., FIG. 5) in which the reading device 28 is not adjacently or otherwise positioned to read the information storage element 18. In one implementation, the second arm 30 may be hinged and rotate between the first position and the second position.

The computer program 34 may be stored in the electronic memory 36, executable by the electronic device 38, and operable to receive input from the reading device 28 regarding the extracted information, receive input regarding the process that uses the material 14, access and examine the database 40 to determine whether the container 12 and the material 14 in the container 12 is correct for the process, and if so, allow the first arm 26 to move to the first position so that the material 14 can be transferred from the container 12. The criteria used to verify the container 14 may be part of the computer program 34, and the information needed to determine whether the criteria are satisfied may be part of the database 40. In one implementation, the criteria used to verify the container 14 are partly or wholly determinable by the operator of the system 10 and can include, e.g., a type of the container 12 and/or the material 14; an expiration date of the container 12 and/or the material 14; a time, day, and/or date at or on which the system 10 is being used; black listed and/or white listed lot numbers; process parameters (e.g., which material(s) is or will be needed); sequence or batch numbers for the container 12 and/or the material 14; a manufacturer of the container 12 and/or the material 14; or an identity of the operator, and any such information may be included in the database 40. After initial installation and verification of the container 12, the computer program 34 may be further operable to continue receiving input from the reading device 28 regarding the extracted information, to continue receiving input regarding the process that uses the material, and to continue determining such factors as whether the container 12 and the material 14 in the container 12 is correct for the process, and whether the material 14 has expired since the container 12 was installed. The computer program 34 may be further operable to collect real-time information regarding operation of the dispensing system 10, and to generate trend or predictive information regarding, e.g., when containers 12 may need to be replaced and when and how many containers 12 may need to be ordered based on such considerations as past consumption, current consumption, or future need.

In various implementations, the electronic device 38 may be, e.g., a computer, a hand-held computing device, or a microprocessor incorporated into the apparatus 20 itself, and may communicate with other components of the dispensing system 10 via the Internet, a local area network (LAN), or a control area network (CAN), and over a wired or wireless connection.

Figure 6:
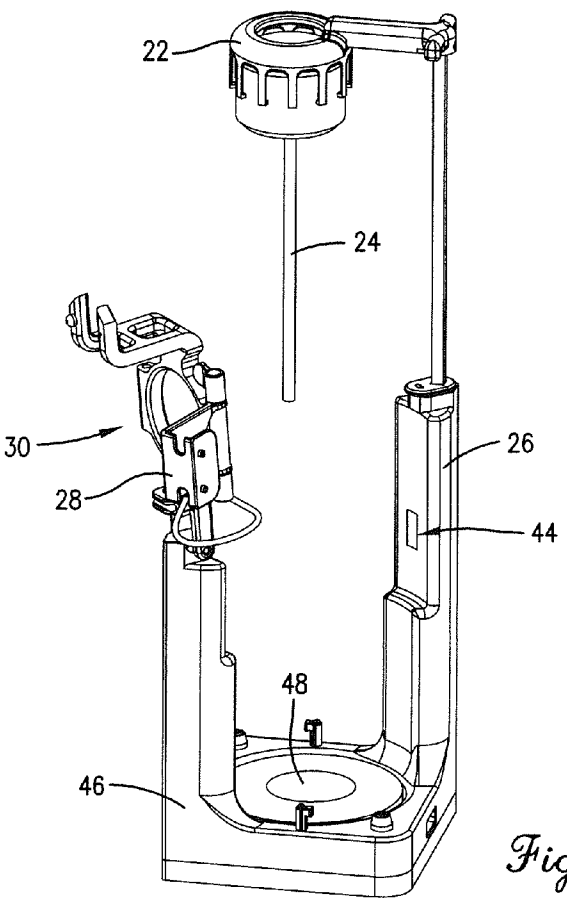
FIG. 6 is an isometric view of the apparatus component of the dispensing system of FIG. 1, wherein the apparatus is shown in a fourth stage of operation.

Referring also to FIG. 6, the apparatus 20 may further include one or more sensors 44 operable to measure a property of the apparatus 20 (e.g., temperature), an environment of the container 12 (e.g., temperature or pressure), the container 12, and/or the material 14 (e.g., amount remaining), and operable to report the measured property to the computer program 34, and wherein the computer program 34 may be operable to consider the reported measured property when determining, e.g., whether to allow the first arm 26 to move to the first position so that the material 14 can be transferred from the container 12.

The apparatus 20 may further include a weight sensor 48 located under the container 12 and operable to periodically or continuously measure a weight of the container 12 and report the measured weight to the computer program 34. In various implementations, the weight sensor 48 may be, e.g., a scale, a load cell, or a strain gauge. The computer program 34 may be operable to determine an amount of material 14 remaining in the container 12 based on the measured weight of the container 12. The computer program 34 may be further operable to predict when the container 12 should be changed based on a declining trend in the weight of the container 12. Relatedly, the computer program 34 may be further operable to access the database 40 to determine an expiration date for the container 12, correlate its prediction regarding when the container 12 should be changed with the expiration date for the container 14, and inform the operator if the container 12 is predicted to last beyond its expiration date.

The apparatus 20 may further include a communication element 50 operable to communicate to the operator of the system 10 such information as successful/unsuccessful physical engagement of a new container 12, successful/unsuccessful verification of the new container 12, successful/unsuccessful release of the engaged container 12, and warning, trend, predictive, real-time, or other information generated by the computer program 34. In various implementations, the communication element 50 may be, e.g., visual in nature, audible in nature, a display screen, one or more lights, a speaker, or a buzzer.

In one implementation, the computer program 34 may be further operable to generate and send alert or other messages (in the form of, e.g., a text or email) to a device, such as a mobile electronic device of the operator or other nearby or remote personnel, regarding an aspect of the operation of the dispensing system 10. Such messages may concern, e.g., a problem with the operation of the apparatus 20, an attempt to install an incorrect container 12, a level of the material 14 in a container 12, an upcoming need to replace a container 12, or current environmental conditions. Some or all of such messages may be communicated via the communication element 50 as well. The operator and/or other personnel may be able to change the nature and content of such messages generated by the computer program 34 to suit their particular needs.

In operation, the dispensing system 10 may function as follows. Referring to FIG. 2 and FIGS. 3-7, the operation of replacing an old container 12*a* with a new container 12*b* begins with the old container 12*a* supported by the support structure 46 and otherwise engaged by the apparatus 20, the first arm 26 in its first position with the connector 22 engaging the mouth 16 of the container 12 and the conduit 24 extending through the mouth 16 to access the material 14, and the second arm 30 in its first position with the reading device 28 positioned adjacent to the information storage element 18, as shown in step 100 and FIG. 3.

Figure 4:
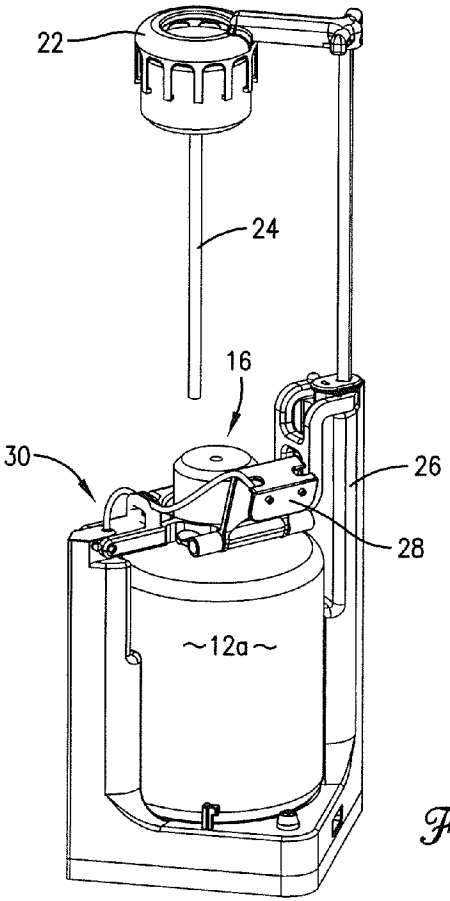
FIG. 4 is an isometric view of the apparatus component of the dispensing system of FIG. 1, wherein the apparatus is shown in a second stage of operation.

The connector 22 disengages the mouth 16 of the container 12, the first arm 26 moves to and locks in its second position by disengaging the connector 22, raising the connector 22 and conduit 24 so that the conduit 24 no longer extends through the mouth 16 of the connector 22, and rotating the connector 22 and conduit 24 away from the mouth 16 so that any material 14 that may drip from the end of the conduit 24 will not fall into the mouth 16 of the new container 12*b* until the new container 12*b* has been verified, as shown in step 102 and FIG. 4.

Figure 5:
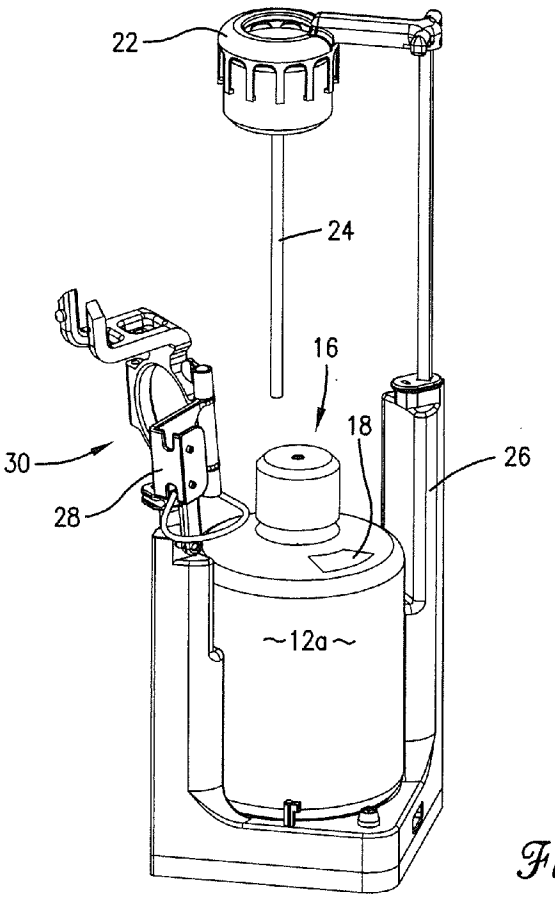
FIG. 5 is an isometric view of the apparatus component of the dispensing system of FIG. 1, wherein the apparatus is shown in a third stage of operation.

The second arm 30 moves to its second position with the reading device 28 not positioned adjacent to the information storage element 18, as shown in step 104 and FIG. 5. The old container 12*a* is removed, and the new container 12*b* is installed in the apparatus 20, as shown in step 106 and FIGS. 6 and 7.

Figure 7:
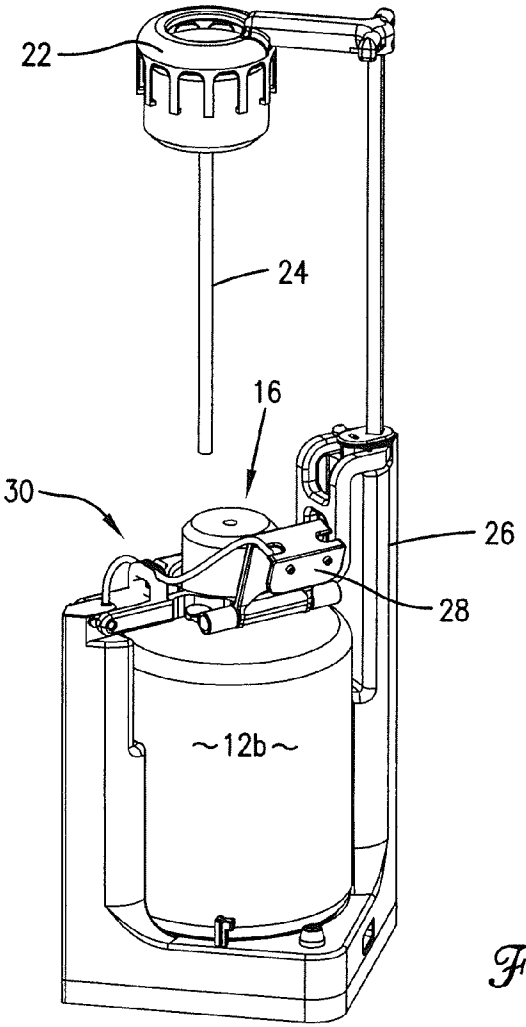
FIG. 7 is an isometric view of the apparatus component of the dispensing system of FIG. 1, wherein the apparatus is shown in a fifth stage of operation.

The second arm 30 moves back to its first position with the reading device 28 positioned adjacent to the information storage element 18 of the new container 12*b*, as shown in step 108 and FIG. 7. The reading device 28 extracts information about the container 12*b* from the information storage element 18, and communicates the information to the computer program 34, as shown in step 110. The computer program 34 determines based on the information provided by reading device 28 and information provided in the database 40 whether the new container 12*b* is the correct container for the process needing the material 14 and therefore meets the criteria for verification, as shown in step 112. If the new container 12*b* does not meet the criteria for verification, the computer program 34 takes appropriate action, as shown in step 114. Appropriate action may include communicating a warning message via the communication element 50 to the operator and/or other personnel, creating an electronic record of the event, not allowing the new container 12*b* to be removed until approval is received, or moving the second arm 30 to its second position so that the incorrect new container 12*b* can be removed and replaced. However, if the new container 12*b* does meet the criteria for verification, the computer program 34 unlocks and allows the first arm 26 to be moved back to its first position so that the material 14 can be transferred to the process in need of it, as shown in step 116 and FIG. 3 (with new container 12*b* replacing old container 12*a*).

Throughout this operation, the movement and other functionality of some or all of the apparatus' components may be accomplished manually by the operator or substantially automatically by the computer program 34. For example, the first and second arms 26,30 may each be manually moved by the operator or substantially automatically moved by the computer program 34 between their respective first and second positions.

Figure 8:
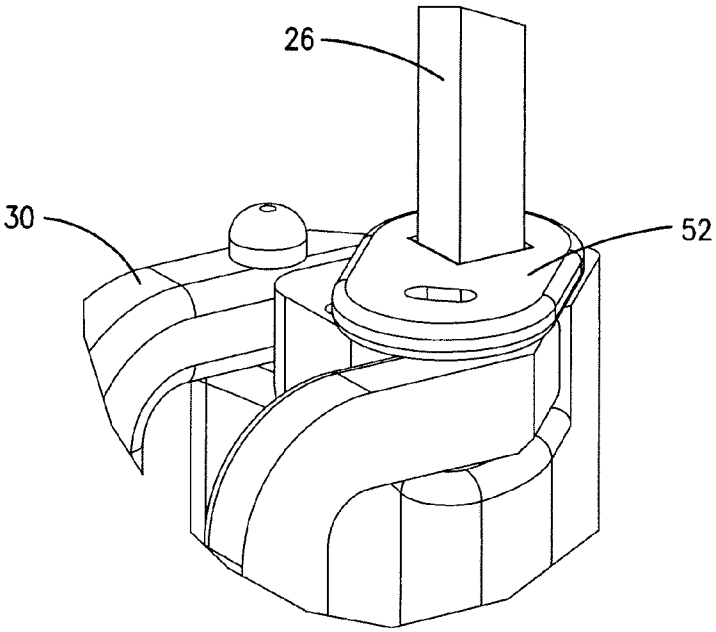
FIG. 8 is a fragmentary view of an implementation of the dispensing system shown in FIG. 1, wherein a tab component is shown in a first position.
Figure 10:
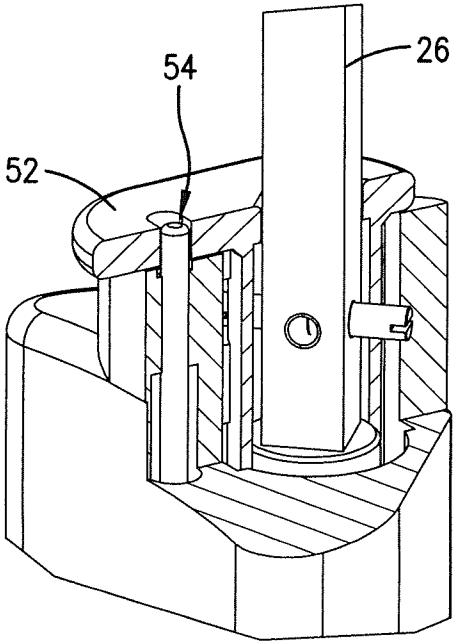
FIG. 10 is a cut-away fragmentary view of the implementation of FIGS. 8 and 9, wherein a pin component is shown in operation relative to the tab component.
Figure 9:
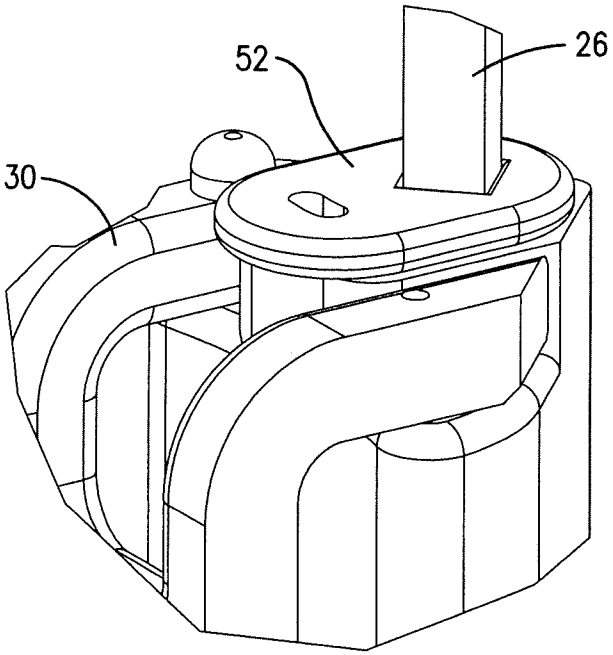
FIG. 9 is a fragmentary view of the implementation of FIG. 8, wherein the tab component is shown in a second position.

Referring to FIGS. 8-10, in one implementation a tab or other projection 52 may be mounted to the first arm 26 in such a manner so as to rotate with the first arm 26 to, as seen in FIG. 8, engage the second arm 30 when the second arm 30 is in its first position and the connector 22 and conduit 24 are positioned over the mouth 16 of the container 12 (i.e., when the first arm 26 is in its first position or transitioning between its first and second positions), and to, as seen in FIG. 9, disengage from the second arm 30 when the connector 22 and conduit 24 are not positioned over the mouth 16 of the container 12 (i.e., when the first arm 26 is in its second position). When the tab 52 is engaged with the second arm 30, the second arm 30 may be unable to move from its first position to its second position, and the container 12 may not be removable from the apparatus 20. Furthermore, as seen in FIG. 10, a pin, pawl, or other movable element 54 may extend and engage with the tab 52 when the first arm 26 is in its second position in such a manner as to prevent the first arm 26 from rotating to position the connector 22 and conduit 24 over the mouth 16 of the container 12 until the container 12 is verified as correct by the computer program 34. Once the container 12 is verified as correct, the pin 54 may retract and disengage from the tab 52 so as to allow the first arm 26 to rotate. As such, the movement of the pin 54 may be substantially automatically controlled by the computer program 34 using an, e.g., solenoid.

In one implementation, an old container 12 is not released by the apparatus for removal until the connector 22 and conduit 24 are secured in the first arm's second position, and the connector 22 and conduit 24 are not allowed to be moved to the first arm's first position until the a new container 12 is secured in the apparatus 20 and verified.

Figure 13:
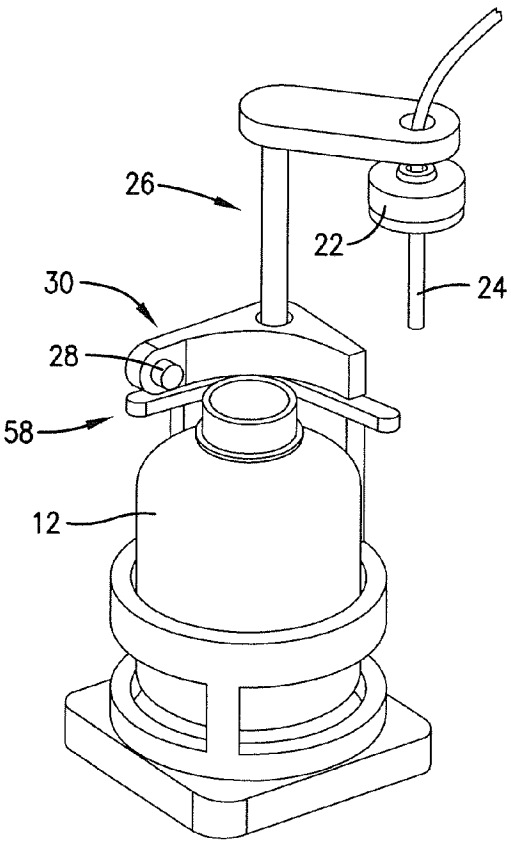
FIG. 13 is an isometric view of the implementation of FIG. 11, wherein the finger components are shown in third positions.
Figure 12:
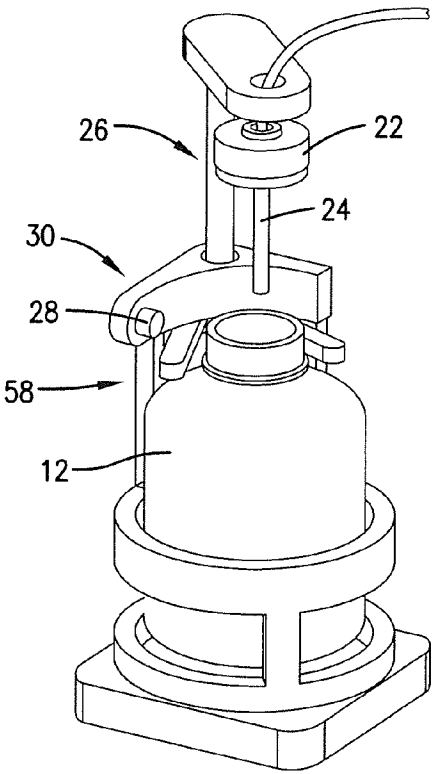
FIG. 12 is an isometric view of the implementation of FIG. 11, wherein the finger components are shown in second positions.
Figure 11:
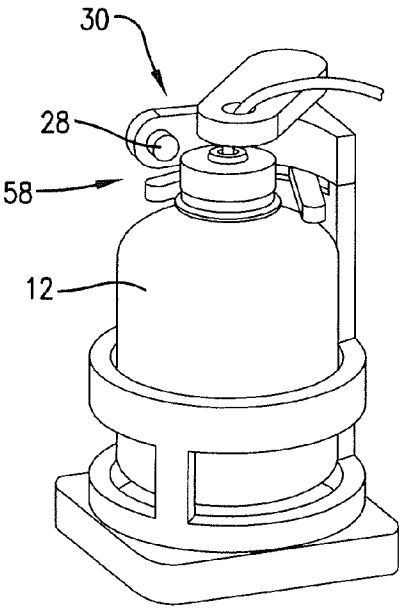
FIG. 11 is an isometric view of an implementation of the dispensing system of FIG. 1, wherein finger components are shown in first positions.

In one implementation, shown in FIGS. 11-13, the second arm 30 may be relatively immovable such that the reading device 28 is relatively fixed in its reading position relative to the container 12 received in the apparatus. In this implementation, first and second fingers 58 may be moveable between a first position (seen in FIGS. 11 and 12) in which they close over or around a portion (e.g., a neck) of the container 12 so as to prevent the container 12 from being removed from the apparatus, and a second position (seen in FIG. 13) in which they open to allow the container 12 to be removed from the apparatus. The first and second fingers 58 may be substantially automatically controlled by the computer program 34.

In one implementation, the connector 22 may be coupled with a retractable tether which retains the connector 22 and conduit 24 in the second retracted and rotated position until the container 12 is verified, and then releases to allow the connector 22 and conduit 24 to move to the first arm's first position.

Figure 14:
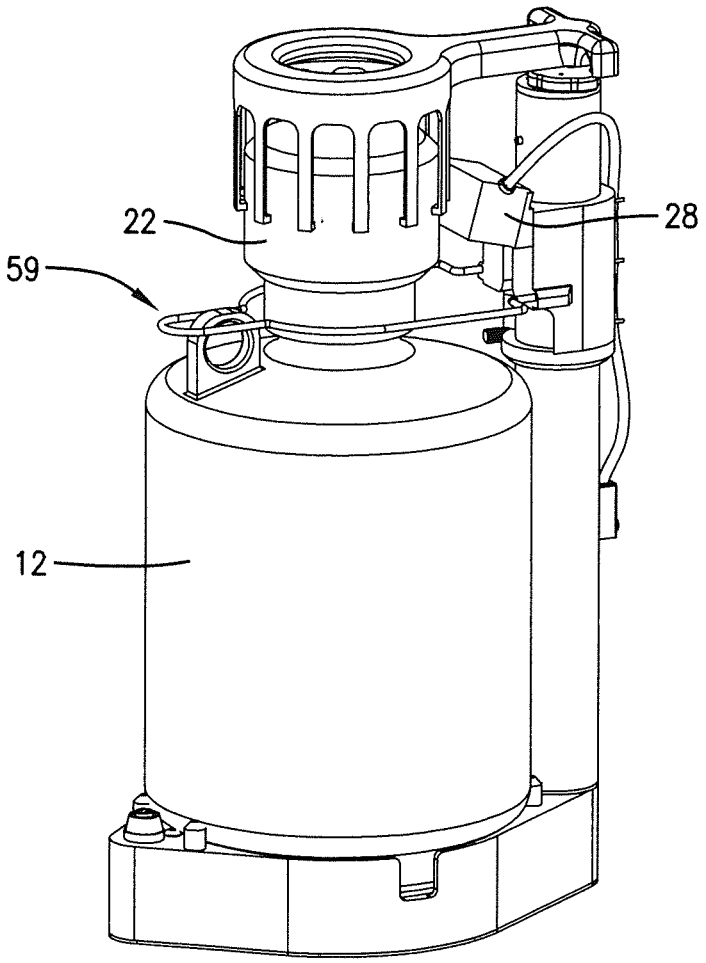
FIG. 14 is an isometric view of an implementation of the apparatus component of the dispensing system of FIG. 1, wherein the apparatus is shown in the first stage of operation.
Figure 15:
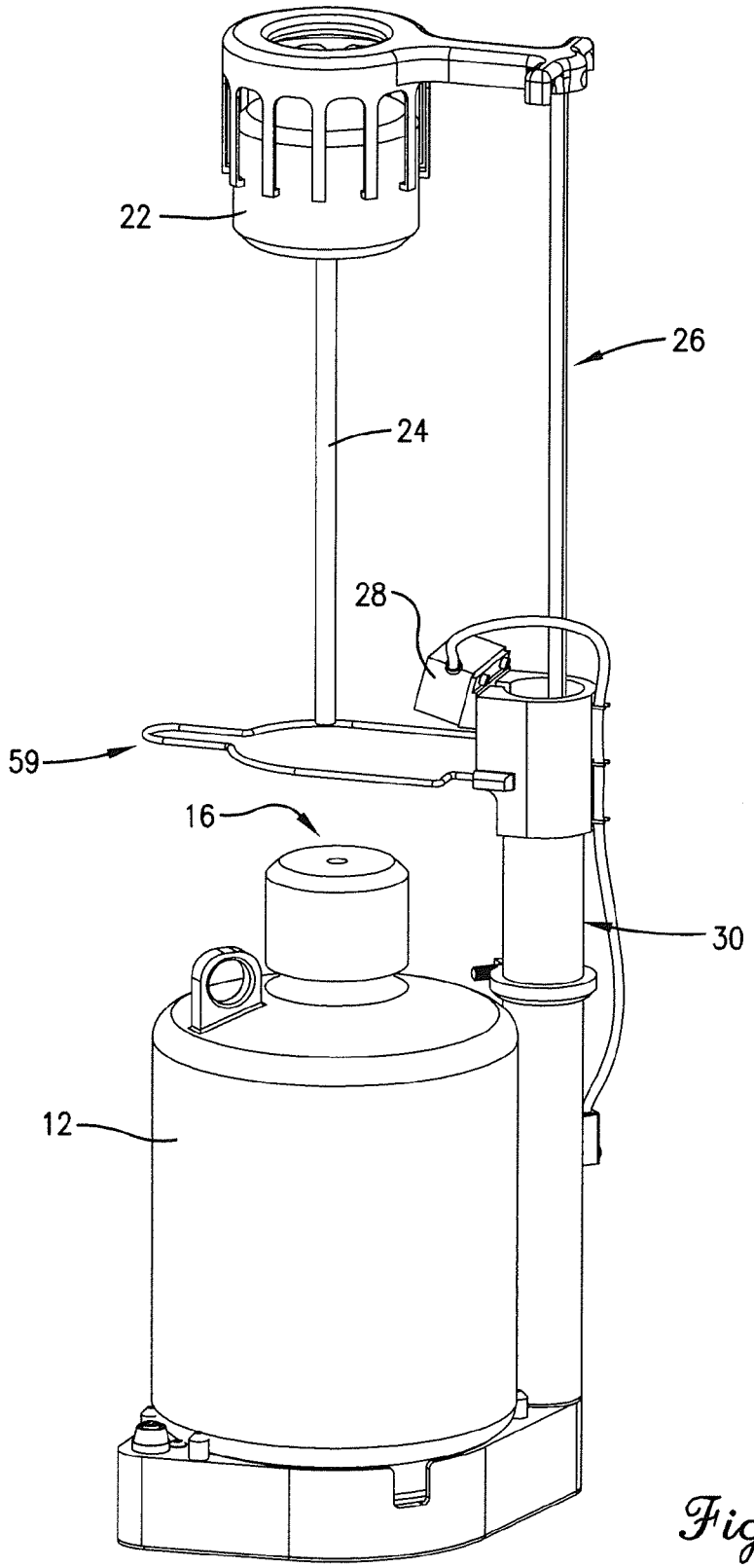
FIG. 15 is an isometric view of apparatus of FIG. 15, wherein the apparatus is shown in the third stage of operation.

In one implementation, shown in FIGS. 14 and 15, the second arm 30 may share a longitudinal axis with the first arm 26, and may move either independently or dependently in substantially the same manner as the first arm 26. More specifically, the first arm 26 may be telescopically or otherwise extendably and retractably nested within the second arm 30, and both the first and second arms 26,30 may be operable to telescope and rotate between the first position shown in FIG. 15 (i.e., both arms 26,30 rotated in and retracted), and the third position shown in FIG. 16 (i.e., both arms 26,30 extended and rotated out). The second arm 30 may include or be associated with a loop 59 or similar structure that fits substantially over and around a portion (e.g., the neck) of the container 12 and prevents it from being moved in substantially the same manner as, e.g., the first and second fingers 58 of the implementation described above. The loop 59 may move with the second arm 30 and not be independently moveable (unlike the first and second fingers 58 which may open and close).

Figure 16:
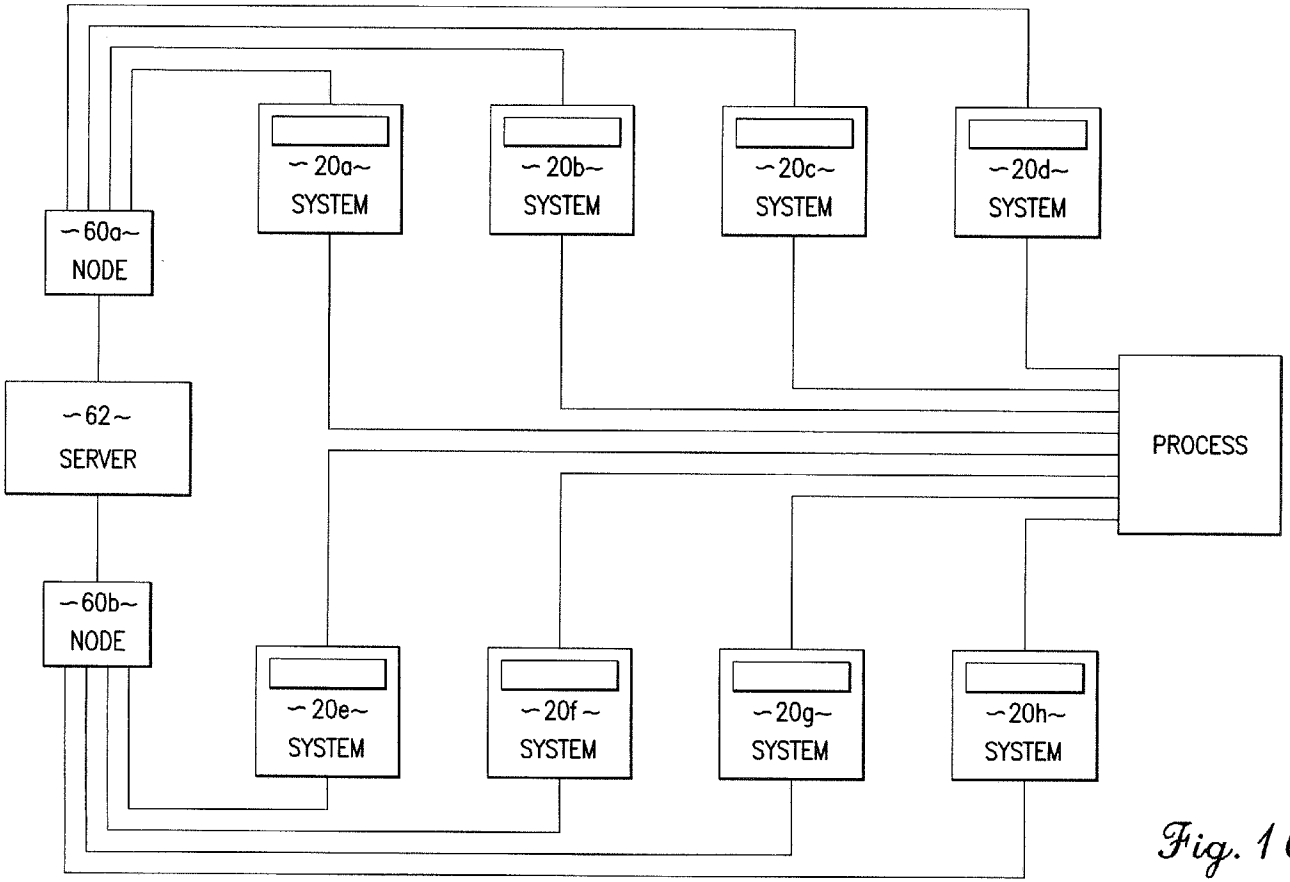
FIG. 16 is a block diagram of the dispensing system of the present invention incorporating multiple instances of the apparatus of FIGS. 3-7.

Referring to FIG. 16, in one implementation, the dispensing system 10 may include multiple apparatuses 20*a-h* operable to simultaneously transfer the same or different materials 14 from multiple containers 12 to one or more processes. Each apparatus 20*a-h* may have its own instance of the computer program 34, or the dispensing system 10 may be managed by a single instance of the computer program 34 operable to simultaneously manage all of the apparatuses 20. The computer program 34 may be operable to, for example, consider material usage rate(s) and predicted container change times to determine whether a stock of the containers 12 of the material(s) 14 is sufficient, and if it is not sufficient, inform the operator of the dispensing system 10. The dispensing system 10 may further include an instance of the electronic device 38 associated with each apparatus 20*a-h,* one or more node controllers 60*a,b,* and a server 62. Each electronic device 38 may be a peripheral component interface (PCI) processor operable to consolidate input and output communication within the dispensing system 10 and communicate with the one or more node controllers 60*a,b* via a computer area network (CAN). Each of the one or more node controllers 60*a,b* may be operable to run on an single-board computing device, and manage operation of some or all of the apparatuses 20*a-h* based on the needs of the process, communicate with the server 62 via a network, and host a local display. The server 62 may be operable to consolidate data from the node controllers 60*a,b,* store and manage information relevant to multiple processes, support all reporting and management functions of the dispensing system 10, and be accessible via a network to substantially any suitable fixed or mobile electronic device using a browser.

In the above-described embodiment, when replacing an old container 12*a* with a new container 12*b,* the connector 22 and conduit 24 are prevented from moving into position over the mouth 16 of the new container 12*b* until the new container 12*b* has been verified. This avoids the risk of any prior material 14 remaining on the end of the conduit 24 dripping into the mouth 16 of the new container 12*b* and if the new container 12*b* is incorrect, potentially contaminating the material in the new container 12*b* and the conduit 24. In a first alternative embodiment, the connector and conduit are substantially stationary and the container is prevented from moving into position under them until the container has been verified. In one implementation of this first alternative embodiment, the container is secured to a moveable element, such as a slidable drawer, and in order to replace an old container with a new container, the connector and conduit are raised, the moveable element is moved from under the connector and conduit, the old container is removed and the new container is placed on the moveable element, and the moveable element is not allowed to move under the connector and conduit until the new bottle has been verified. In a second alternative embodiment, both the connector, conduit, and container are all substantially stationary and a barrier is interposed between the connector and conduit and the mouth of the container and the barrier is not removed until the container is verified. In one implementation of this second alternative embodiment, in order to replace an old container with a new container, the connector and conduit are raised, the old container is removed from the apparatus, a mechanical barrier is moved (using, e.g., an electrical, pneumatic, or hydraulic mechanism) under the connector and conduit, a new container is placed in the apparatus, and the mechanical barrier is not allowed to move from between the connector and conduit and the container until the new container has been verified.

Thus, the present invention provides advantages over the prior art, including that the dispensing system 10 verifies the container 12 of the material 14 before the material 14 is transferred from the container 12 to the process that use the material 14, wherein the dispensing system 10 combines the mechanical advantages of a key-based system with the informational and analytical advantages of a label-based system to greatly reduce mistakes and contamination.

Although the invention has been described with reference to the one or more embodiments illustrated in the figures, it is understood that equivalents may be employed and substitutions made herein without departing from the scope of the invention as recited in the claims.

Having thus described one or more embodiments of the invention, what is claimed as new and desired to be protected by Letters Patent includes the following:

1. A non-transitory computer readable storage medium with an executable program stored thereon for managing a dispensing system, including verifying a container of a material before the material is transferred from the container to a process that uses the material, wherein the container has a mouth, and wherein the dispensing system includes a conduit operable to extend through the mouth of the container and transfer the material from the container, and a first arm supporting the conduit and operable to move between a first position in which the conduit extends through the mouth of the container, and a second position in which the conduit is removed from the mouth of the container and moved away from the container such that the conduit is not positioned over the mouth of the container, and wherein the program instructs a processing element to perform the following steps:

locking the first arm in the second position and preventing the first arm from moving to the first position;

receiving a first input regarding the container;

receiving a second input regarding the process that uses the material;

determining based on the first and second inputs whether the container is correct for the process that uses the material; and if the container is correct, allowing the first arm to move to the first position so that the material can be transferred from the container.

2. A non-transitory computer readable storage medium with an executable program stored thereon for managing a dispensing system, including verifying a container of a material before the material is transferred from the container to a process that uses the material, wherein the container has a mouth and presents an information storage element, and wherein the dispensing system includes— an apparatus including— a conduit operable to extend through the mouth of the container and transfer the material from the container, a first arm supporting the conduit and operable to move between— a first position in which the conduit extends through the mouth of the container, and a second position in which the conduit is removed from the mouth of the container and moved away from the container such that the conduit is not positioned over the mouth of the container, a reading device operable to extract information about the container and the material in the container from the information storage element, and wherein the program instructs a processing element to perform the following steps:

preventing the first arm from moving to the first position;

receiving a first input from the reading device regarding the extracted information;

receiving a second input regarding the process that uses the material;

determining based on the first and second inputs whether the container and the material in the container are correct for the process that uses the material; and if the container and the material in the container are correct, allowing the first arm to move to the first position so that the material can be transferred from the container.

3. The non-transitory computer readable storage medium as set forth in claim 2, wherein the container is a bottle.

4. The non-transitory computer readable storage medium as set forth in claim 2, wherein the material is a liquid.

5. The non-transitory computer readable storage medium as set forth in claim 2, wherein the information storage element is selected from the consisting of: a label, a tag, a radio-frequency identification device tag, an optical identification tag, a magnetic identification tag.

6. The non-transitory computer readable storage medium as set forth in claim 2, wherein the conduit is a tube.

7. The non-transitory computer readable storage medium as set forth in claim 2, wherein the first arm is telescopic and rotates and retracts to achieve the first position and extends and rotates to achieve the second position.

8. The non-transitory computer readable storage medium as set forth in claim 2, wherein the reading device is selected from the group consisting of: a quick response code reader, a linear bar code reader, a camera, a radio-frequency identification tag reader, an optical character recognition scanner, a magnetic media reading device.

9. The non-transitory computer readable storage medium as set forth in claim 2, further including a second arm supporting the reading device and operable to move between— a first position in which the reading device is positioned to read the information storage element; and a second position in which the reading device is not positioned to read the information storage element.

10. The non-transitory computer readable storage medium as set forth in claim 2, wherein the second arm is hinged and rotates between the first position and the second position.

11. The non-transitory computer readable storage medium as set forth in claim 2, wherein the determination of whether the container and the material in the container is correct for the process is based on a set of verification criteria used by the program, and information needed to determine whether the set of verification criteria is satisfied is contained in a database which is accessed by the computer program.

12. The non-transitory computer readable storage medium as set forth in claim 11, wherein the set of verification criteria is at least partly determinable by an operator of the dispensing system.

13. The non-transitory computer readable storage medium as set forth in claim 11, wherein the set of verification criteria is selected from the group consisting of: a type of the material; a type of the container; an expiration date of the material; a time, day, or date at or on which the dispensing system is being used; lot numbers; process parameters, including which material is needed; a sequence or batch number; a manufacturer of the container or the material; an identity of the operator.

14. The non-transitory computer readable storage medium as set forth in claim 2, the apparatus further including one or more sensors operable to measure a property of the apparatus, an environment of the container, the container, or the material, and to report the measured property to the program, and wherein the program is further operable to instruct the processing element to consider the reported measured property when determining whether to allow the first arm to move to the first position so that the material can be transferred from the container.

15. The non-transitory computer readable storage medium as set forth in claim 2, the apparatus further including a weight sensor operable to measure a weight of the container and report the measured weight to the program, wherein the program is further operable to instruct the processing element to determine an amount of the material remaining in the container based on the measured weight of the container.

16. The non-transitory computer readable storage medium as set forth in claim 15, wherein the weight sensor is selected from the group consisting of: a scale, a load cell, a strain gauge.

17. The non-transitory computer readable storage medium as set forth in claim 2, the apparatus further including a communication element operable to communicate engagement of a new container, verification of the new container, release of an engaged container, and warning, trend, predictive, and real-time information generated by the program about operation of the apparatus and the container.

18. The non-transitory computer readable storage medium as set forth in claim 17, wherein the communication element is selected from the group consisting of: visual communication elements, audible communication elements, a display screen, one or more lights, a speaker, a buzzer.

19. The non-transitory computer readable storage medium as set forth in claim 2, wherein the program is further operable to instruct the processing element to generate and send a message to an electronic device concerning an aspect of the operation of the dispensing system.

20. The non-transitory computer readable storage medium as set forth in claim 19, wherein the electronic device is a mobile electronic device.

21. The non-transitory computer readable storage medium as set forth in claim 19, wherein the message concerns a subject selected form the group consisting of: a problem with the apparatus, an attempt to install an incorrect container, a level of the material in the container, an upcoming need to replace the container, or a current environmental condition.

22. The non-transitory computer readable medium as set forth in claim 2, wherein after the container is installed in the apparatus and verified by the computer program, the computer program may be further operable to continue receiving input from the reading device regarding the extracted information, to continue receiving input regarding the process that uses the material, and to continue determining whether the container and the material in the container are correct for the process and whether the material in the container has expired.

23. A non-transitory computer readable storage medium with an executable program stored thereon for managing a dispensing system, including verifying a container of a material before the material is transferred from the container to a process that uses the material, wherein the container has a mouth and presents an information storage element, and wherein the dispensing system includes— a plurality of apparatuses operable to simultaneously transfer one or more materials from a plurality of containers to one or more processes, with each apparatus including— a connector operable to engage the container, a conduit operable to extend through the mouth of the container and transfer the material from the container, a first arm supporting the connector and the conduit and operable to move between— a first position in which the connector is engaged with the container and the conduit extends through the mouth of the container, and a second position in which the connector is disengaged from the container and the conduit is removed from the mouth of the container and moved away from the container such that the conduit is not positioned over the mouth of the container, a reading device operable to extract information about the container and the material in the container from the information storage element, and wherein the program instructs a processing element to perform the following steps:

preventing the first arm from moving to the first position;

receiving a first input from the reading device regarding the extracted information;

receiving a second input regarding the process that uses the material;

determining based on the first and second inputs whether the container and the material in the container are correct for the process that uses the material; and if the container and the material in the container are correct, allowing the first arm to move to the first position so that the material can be transferred from the container.

24. The non-transitory computer readable storage medium as set forth in claim 23, wherein each of the plurality of apparatuses is managed by a separate instance of the program.

25. The non-transitory computer readable storage medium as set forth in claim 23, wherein all of the plurality of apparatuses are managed by a single instance of the program.

26. A method of managing a dispensing system, including verifying a container of a material before the material is transferred from the container to a process that uses the material, wherein the container has a mouth, and wherein the dispensing system includes a conduit operable to extend through the mouth of the container and transfer the material from the container, and a first arm supporting the conduit and operable to move between a first position in which the conduit extends through the mouth of the container, and a second position in which the conduit is removed from the mouth of the container and moved away from the container such that the conduit is not positioned over the mouth of the container, and wherein the method comprises the steps of:

(1) locking the first arm in the second position and preventing the first arm from moving to the first position;

(2) extracting first information regarding the container from an information storage element associated with the container;

(3) receiving second information regarding the process that uses the material;

(4) determining based on the first and second information whether the container is correct for the process that uses the material; and (5) if the container is correct, allowing the first arm to move to the first position so that the material can be transferred from the container.

27. A method of managing a dispensing system, including verifying a container of a material before the material is transferred from the container to a process that uses the material, wherein the container has a mouth and presents an information storage element, and wherein the dispensing system includes— an apparatus including— a conduit operable to extend through the mouth of the container and transfer the material from the container, a first arm supporting the conduit and operable to move between— a first position in which the conduit extends through the mouth of the container, and a second position in which the conduit is removed from the mouth of the container and moved away from the container such that the conduit is not positioned over the mouth of the container, a reading device operable to extract first information about the container and the material in the container from the information storage element, and wherein the method comprises the steps of:

(1) locking the first arm in the second position and preventing the first arm from moving to the first position;

(2) receiving from the reading device the first information regarding the container and the material in the container;

(3) receiving second information regarding the process that uses the material;

(4) determining based on the first and second information whether the container and the material in the container are correct for the process that uses the material; and (5) if the container is correct, allowing the first arm to move to the first position so that the material can be transferred from the container.

28. The method as set forth in claim 27, wherein the container is a bottle.

29. The method as set forth in claim 27, wherein the material is a liquid.

30. The method as set forth in claim 27, wherein the information storage element is selected from the consisting of: a label, a tag, a radio-frequency identification device tag, an optical identification tag, a magnetic identification tag.

31. The method as set forth in claim 27, wherein the conduit is a tube.

32. The method as set forth in claim 27, wherein the first arm is telescopic and rotates and retracts to achieve the first position and extends and rotates to achieve the second position.

33. The method as set forth in claim 27, wherein the reading device is selected from the group consisting of: a quick response code reader, a linear bar code reader, a camera, a radio-frequency identification tag reader, an optical character recognition scanner, a magnetic media reader.

34. The method as set forth in claim 27, further including a second arm and the step of the second arm moving between— a first position in which the reading device is positioned to read the information storage element; and a second position in which the reading device is not positioned to read the information storage element.

35. The method as set forth in claim 34, wherein the second arm is hinged and rotates between the first position and the second position.

36. The method as set forth in claim 27, wherein, in step (3), determining whether the container and the material in the container are correct for the process is based on a set of verification criteria, and information needed to determine whether the set of verification criteria is satisfied is contained in a database which is accessed by the computer program.

37. The method as set forth in claim 36, wherein the set of verification criteria is at least partly determinable by an operator of the dispensing system.

38. The method as set forth in claim 36, wherein the set of verification criteria is selected from the group consisting of: a type of the material; a type of the container; an expiration date of the material; a time, day, or date at or on which the dispensing system is being used; lot numbers; process parameters, including which material is needed; a sequence or batch number; a manufacturer of the container or the material; an identity of the operator.

39. The method as set forth in claim 27, the apparatus further including one or more sensors operable to measure a property of the apparatus, an environment of the container, the container, or the material and to report the measured property as third information, and the method further including the step of receiving and considering the third information when determining whether to allow the first arm to move to the first position so that the material can be transferred from the container.

40. The method as set forth in claim 27, the apparatus further including a weight sensor operable to measure a weight of the container and report the measured weight as third information, and the method further including the step of receiving and using the third information to determine an amount of the material remaining in the container.

41. The method as set forth in claim 40, wherein the weight sensor is selected from the group consisting of: a scale, a load cell, a strain gauge.

42. The method as set forth in claim 27, the apparatus further including a communication element, and the method further including the step of communicating via the communication element engagement of a new container, verification of the new container, and release of an old container.

43. The method as set forth in claim 27, further including the step of generating warning, trend, predictive, and real-time information program about operation of the apparatus and the container.

44. The method as set forth in claim 27, further including the step of generating and communicating a message to a mobile electronic device concerning an aspect of the operation of the dispensing system.

45. The method as set forth in claim 44, wherein the message concerns a subject selected from the group consisting of: a problem with the apparatus, an attempt to install an incorrect container, a level of the material in the container, an upcoming need to replace the container, or a current environmental condition.

46. The method as set forth in claim 27, wherein after the container is installed in the apparatus and verified by the computer program, the computer program may be further operable to continue receiving input from the reading device regarding the extracted information, to continue receiving input regarding the process that uses the material, and to continue determining whether the container and the material in the container are correct for the process and whether the material in the container has expired.

47. A method of managing a dispensing system, including verifying a container of a material before the material is transferred from the container to a process that uses the material, wherein the container has a mouth and presents an information storage element, and wherein the dispensing system includes— a plurality of apparatuses operable to simultaneously transfer one or more materials from a plurality of containers to one or more processes, with each apparatus including— a connector operable to engage the container, a conduit operable to extend through the mouth of the container and transfer the material from the container, a first arm supporting the connector and the conduit and operable to move between— a first position in which the connector is engaged with the container and the conduit extends through the mouth of the container, and a second position in which the connector is disengaged from the container and the conduit is removed from the mouth of the container and moved away from the container such that the conduit is not positioned over the mouth of the container, and wherein, for each of the apparatuses, the method comprises the steps of:

(1) locking the first arm in the second position and preventing the first arm from moving to the first position;

(2) extracting first information regarding the container from an information storage element associated with the container;

(3) receiving second information regarding the process that uses the material;

(4) accessing a database to determine based on the first and second information whether the container is correct for the process that uses the material;

(5) if the container is correct, allowing the first arm to move to the first position so that the material can be transferred from the container, wherein steps (1) through (5) are performed substantially independently for each of the apparatuses.

* * * * *